US011370999B2

(12) United States Patent
Scheufling et al.

(10) Patent No.: US 11,370,999 B2
(45) Date of Patent: Jun. 28, 2022

(54) FORMULATIONS AND METHOD FOR LOW TEMPERATURE CLEANING OF DAIRY EQUIPMENT

(71) Applicant: Diversey, Inc., Fort Mill, SC (US)

(72) Inventors: Joerg L. Scheufling, Heltenieidelheim (DE); Ingo Mistele, Mannheim (DE); Henry Von Rege, Alzey (DE)

(73) Assignee: Diversey, Inc., Fort Mill, SC (US)

( * ) Notice: Subject to any disclaimer, the term of this patent is extended or adjusted under 35 U.S.C. 154(b) by 90 days.

(21) Appl. No.: 16/479,067

(22) PCT Filed: Jan. 19, 2018

(86) PCT No.: PCT/US2018/014342
§ 371 (c)(1),
(2) Date: Jul. 18, 2019

(87) PCT Pub. No.: WO2018/136693
PCT Pub. Date: Jul. 26, 2018

(65) Prior Publication Data

US 2019/0382696 A1 Dec. 19, 2019

Related U.S. Application Data

(60) Provisional application No. 62/447,957, filed on Jan. 19, 2017.

(51) Int. Cl.

| | |
|---|---|
| ***B08B 3/10*** | (2006.01) |
| ***C11D 11/00*** | (2006.01) |
| ***C11D 1/66*** | (2006.01) |
| ***C11D 1/72*** | (2006.01) |
| ***C11D 1/722*** | (2006.01) |
| ***C11D 1/74*** | (2006.01) |
| ***C11D 3/04*** | (2006.01) |
| ***C11D 3/32*** | (2006.01) |
| ***C11D 3/33*** | (2006.01) |
| ***C11D 3/36*** | (2006.01) |
| ***C11D 3/37*** | (2006.01) |
| ***C11D 17/00*** | (2006.01) |

(52) U.S. Cl.
CPC ..... *C11D 11/0041* (2013.01); *B08B 3/10* (2013.01); *C11D 1/662* (2013.01); *C11D 1/72* (2013.01); *C11D 1/722* (2013.01); *C11D 1/74* (2013.01); *C11D 3/042* (2013.01); *C11D 3/044* (2013.01); *C11D 3/323* (2013.01); *C11D 3/33* (2013.01); *C11D 3/365* (2013.01); *C11D 3/3765* (2013.01); *C11D 17/0008* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,786,319 | A | 7/1998 | Pedersen et al. | |
| 5,861,366 | A | 1/1999 | Ihns et al. | |
| 6,197,739 | B1 | 3/2001 | Oakes et al. | |
| 6,425,959 | B1 | 7/2002 | Man | |
| 7,179,781 | B2 | 2/2007 | Fine et al. | |
| 8,246,696 | B2 | 8/2012 | Man et al. | |
| 8,653,015 | B2 | 2/2014 | Keller et al. | |
| 2003/0064911 | A1 | 4/2003 | Rouillard et al. | |
| 2004/0182425 | A1* | 9/2004 | Kravitz | C11D 11/0035 134/26 |
| 2010/0021557 | A1 | 1/2010 | Li et al. | |
| 2012/0264673 | A1 | 10/2012 | Keller et al. | |
| 2014/0261546 | A1 | 9/2014 | Erickson et al. | |
| 2015/0152364 | A1* | 6/2015 | Theyssen | C11D 3/3757 510/234 |

FOREIGN PATENT DOCUMENTS

| | | | |
|---|---|---|---|
| JP | 2006265469 | A | 10/2006 |
| JP | 2017002250 | A | 5/2017 |
| WO | 96/06910 | A2 | 3/1996 |
| WO | 2008/109121 | A1 | 9/2008 |
| WO | 2010/045686 | A1 | 4/2010 |
| WO | 2010/146543 | A2 | 12/2010 |
| WO | 2013/185074 | A2 | 12/2013 |
| WO | 2016/046334 | A1 | 3/2016 |
| WO | 2016/079110 | A2 | 5/2016 |
| WO | 2018-113979 | A1 | 6/2018 |

OTHER PUBLICATIONS

Office Action of counterpart European Application No. 18703155.4 dated Nov. 23, 2020; 8 pages.
Office Action of counterpart Indian Application No. 201937029935 dated Feb. 9, 2021; 6 pages.
Office Action of counterpart Chinese Patent Application No. 201880019535.X dated Jul. 27, 2020; 6 pages.
International Search Report for counterpart Application No. PCT/US2018/014342 dated Jun. 29, 2018; 7 pages.

(Continued)

*Primary Examiner* — Erin F Bergner
(74) *Attorney, Agent, or Firm* — Warunee Srisiri-Sisson

(57) ABSTRACT

A formulation having at least one of a product stabilization solvent, a sequestrant or chelating agent, and an alkalinity agent capable of use in a cleaning operation at a reduced temperature. Optionally, the formulation may additionally comprise any one or more of a degreaser emulsifier solvent, a surfactant, a hydrotrope, a stabilizer, a biocide, and a buffer. An additive formulation of the invention, as defined herein, comprises these stated types of compounds and is combined with an alkalinity agent at the time of the formulations use in a reduced temperature dairy equipment cleaning operation. A full formulation of the invention, as defined herein, additionally comprises an alkalinity agent in addition to the other named compounds. In many cases, the full formulations are used in a reduced temperature dairy equipment cleaning operation without being combined with an additional alkalinity agent. The reduced temperature of the dairy equipment cleaning operation using the formulation of the invention may be less than about 50° C. or, alternatively, less than about 40° C.

20 Claims, No Drawings

(56) References Cited

OTHER PUBLICATIONS

Thomas et al., Cleaning-In-Place (CIP) System in Dairy Plant-Review; IOSR Journal of Environmental Science, Toxicology and Food technology; vol. 8, Issue 6, Ver. III, Jun. 2014; pp. 41-44.
International Preliminary Report on Patentability for Application No. PCT/US2018/014342 dated Aug. 1, 2019; 18 pages.
Office Action of counterpart Chinese Patent Application No. 201880019535.X dated Mar. 25, 2021; 17 pages.
Haiyun Hou; "Basics of Physics and Chemistry of Surfactants," Xi'an Jiaotong University Press, Sep. 2014; 2 pages; p. 147 translated.

* cited by examiner

FORMULATIONS AND METHOD FOR LOW TEMPERATURE CLEANING OF DAIRY EQUIPMENT

CROSS-REFERENCE TO RELATED APPLICATIONS

This application is a National Phase of PCT International Application No PCT/US2018/014342, filed on Jan. 19, 2018, which claims priority to U.S. Provisional Application No. 62/447,957, filed on Jan. 19, 2017; the content of these patent applications are incorporated herein by reference in its entirety.

FIELD OF INVENTION

The present invention relates to formulations for use in a reduced temperature dairy equipment cleaning operation relative to the processing temperatures of conventional dairy equipment cleaning operations. The present invention also provides the method of use for such formulations.

BACKGROUND

Dairy processing of milk may utilize heat sterilization to prevent microbial contamination. The use of treatment chemicals may be determinative of the extent of heat that must be used in such a treatment. Such a processing technique at the sterilization temperatures conventionally required will also cause the deposition of milk-borne, specifically proteinaceous type materials, onto the surfaces of the processing equipment. Also, during dairy processing, a milk-borne layer may be formed onto surfaces of dairy processing equipment. Depending on the temperature, a soil layer may be simply dried or burnt onto the surface. Heat that is used as part of the sterilization process to prevent and reduce microbial contamination in milk or other means of heat treatment leads to the buildup of milk-borne, specifically proteinaceous type materials onto the surfaces of process equipment. These milk-borne soil layers, especially proteinaceous types of soil can be difficult to remove without the use of a cleaning process formulation having an oxidizer and a certain level of alkalinity to promote fat removal. Cleaning may additionally or instead be performed at a higher temperature to improve the detergency action of the formulation. Oxidizers that are most conventionally used are chlorine-based cleaning agents, which can pose certain environmental and safety problems. Thus, there is an emphasis to substitute these chlorine-based oxidizers with non-chlorinated cleaning agents that still meet or even exceed the cleaning capability of chlorine-based oxidizers. The use of heat applied during both processing of the dairy product and during the cleaning process may cause the deposition of undesirable compounds on the surface of the equipment. Thus, there is a motivation in the art to reduce the amount of heat that is applied during the cleaning process.

Conventionally, clean-in-place (CIP) systems are used to clean the dairy processing equipment. CIP methods involve filling the equipment with cleaning solution(s) and flushing such solution(s) from the equipment to remove any contaminant from the equipment surfaces. Conventionally, ambient to Luke-warm water in the temperature range of 5° C. to 50° C. is used for the rinse followed by a hot wash using an oxidizing agent, an alkalinity agent and/or an acidic agent in the temperature range of 60° C. to 80° C. The final step typically involves a cold, ambient temperature rinse.

The final rinse step may include an acidic rinse (a phosphoric acid-based wash is typically used), a disinfectant and/or a sanitizer.

Enzymatic treatment has also been used in the primary cleaning operation for such equipment. Enzymes that have conventionally been used particularly include proteolytic enzymes or proteases used to break the deposited proteinaceous materials down into smaller compounds. Enzymatic treatment needs to be followed by an inactivation step to guarantee no transfer of active enzymes into the dairy product. Such inactivation can, for example, be performed by an additional acidic wash.

CIP processes typically involve the necessary tanks, pumps and control systems to carry out the cleaning operation. It is preferred that any new formulation and/or cleaning operation be capable of utilizing such cleaning equipment that is currently in place without a need for significant modification to such equipment.

There remains a need in the art to provide a formulation and a CIP operation that reduces the costs associated with the cleaning operation. A long-felt need that exists is a formulation, even more preferably a chlorine-free formulation, that allows for at least a comparable ability to clean the equipment but at a reduced temperature operation over the temperatures that have conventionally been used in the CIP operation. A reduced temperature operation will allow for energy savings and a reduction in cost associated with such reduced energy usage.

SUMMARY OF INVENTION

The present invention relates to a formulation for use in a reduced temperature dairy equipment cleaning operation relative to the processing temperatures of conventional cleaning operations. Without intending to be bound by theory, the formulation of the invention results in a reduced temperature dairy equipment cleaning operation operating lower than about 50° C. or lower than about 40° C.

In an embodiment of the invention, a concentration of the alkalinity agent in the cleaning solution is from about 0.1 wt % to about 0.5 wt % based upon the weight of the cleaning solution. In a preferred embodiment of the invention, the concentration of the alkalinity agent in the cleaning solution is from about 0.1 wt % to about 0.3 wt % based upon the weight of the cleaning solution.

In one aspect, the invention provides a formulation for a cleaning solution for use in a reduced temperature dairy equipment cleaning operation, the formulation comprising a sequestrant and a surfactant and the cleaning solution comprising an alkalinity agent. Further pursuant to this embodiment of the invention, the reduced temperature is about 50° C. or less, while in yet other embodiments of the invention, the reduced temperature is about 40° C. or less.

In one embodiment of the invention, a dairy equipment of the reduced temperature dairy equipment cleaning operation does not substantially comprise burnt-in soil at the surface of the dairy equipment.

In an embodiment of the invention, the formulation is an additive formulation that is later mixed with the alkalinity agent in a cleaning solution for use in a reduced temperature dairy equipment cleaning operation. In certain embodiments of the invention, the additive formulation may additionally comprise a product stabilization solvent, a degreaser/emulsifier solvent, and, optionally, a hydrotrope.

In certain embodiments of the invention, the additive formulation may comprise up to about 97.7 wt % of the product stabilization solvent, from about 1 wt % to about 20 wt % of the degreaser/emulsifier solvent, from about 1 wt % to about 20 wt % of the hydrotrope, from about 0.1 wt % to about 20 wt % of the sequestrant, and from about 0.2 wt % to about 20 wt % of the surfactant all by weight of the formulation.

In certain embodiments of the invention, the additive formulation may comprise from about 45 wt % to about 92.5 wt % of the product stabilization solvent, from about 3 wt % to about 12 wt % of the degreaser/emulsifier solvent, from about 3 wt % to about 20 wt % of the hydrotrope, from about 1 wt % to about 15 wt % of the sequestrant, and from about 0.5 wt % to about 18 wt % of the surfactant all by weight of the formulation.

In certain embodiments of the invention, the additive formulation comprises from about 40 wt % to about 82.5 wt %, or from about 53.5 wt % to about 60 wt % in other embodiments of the invention, of the product stabilization solvent, from about 8 wt % to about 10 wt % of the degreaser/emulsifier solvent, from about 5.5 wt % to about 20 wt % of the hydrotrope, from about 3 wt % to about 12 wt % of the sequestrant, and from about 1 wt % to about 18 wt % of the surfactant all by weight of the formulation. In certain embodiments of the invention, the product stabilization solvent comprises water; the degreaser/emulsifier solvent comprises at least one of an alcohol and a glycol and, in a preferred embodiment of the invention, a dipropylene glycol methyl ether; the hydrotrope comprises any one or more of a salt of cumene sulfonic acid, a salt of xylene sulphonic acid, a glycolic acid and a salt of a fatty acid; the sequestrant comprises any one or more of an ethylene diamine tetraacetic acid (EDTA), a methylglycine diacetic acid (MGDA) and a poly(acrylic acid) (PAA) (M=4.5 k); and the surfactant comprises any one or more of an alcohol alkoxylate that includes an ethylene oxide/propylene oxide (EO/PO) and an alcohol alkoxylate that includes an ethylene oxide/butylene oxide (EO/BO). Of course, other solvents, degreaser/emulsifiers, hydrotropes, sequestrants and surfactants known in the art may be included in the formulations of the invention.

In certain embodiments of the invention, the additive formulation additionally comprises a product stabilization solvent, a degreaser/emulsifier solvent, and, optionally, a hydrotrope functional surfactant. In an embodiment of the invention, the hydrotrope functional surfactant may comprise at least one of an amphoteric surfactant and a nonionic surfactant. In certain embodiments of the invention, the nonionic surfactant of the hydrotrope functional surfactant comprises an alkyl polyglucoside.

In certain embodiments of the invention, the formulation comprises up to about 97.7 wt % of the product stabilization solvent, from about 1 wt % to about 20 wt % of the degreaser/emulsifier solvent, from about 0.1 wt % to about 20 wt % of the hydrotrope functional surfactant, from about 0.1 wt % to about 20 wt % of the sequestrant, and from about 0.2 wt % to about 20 wt % of the surfactant all by weight of the formulation. In certain other embodiments of the invention, the formulation comprises from about 45 wt % to about 92.5 wt % of the product stabilization solvent, from about 3 wt % to about 12 wt % of the degreaser/emulsifier solvent, from about 0.2 wt % to about 15 wt % of the hydrotrope functional surfactant, from about 1 wt % to about 15 wt % of the sequestrant, and from about 0.5 wt % to about 18 wt % of the surfactant all by weight of the formulation. In yet certain other embodiments of the invention, the formulation comprises from about 40 wt % to about 82.5 wt % of the product stabilization solvent, from about 8 wt % to about 10 wt % of the degreaser/emulsifier solvent, from about 0.5 wt % to about 5 wt % of the hydrotrope functional surfactant, from about 3 wt % to about 12 wt % of the sequestrant, and from about 1 wt % to about 18 wt % of the surfactant all by weight of the formulation.

In an embodiment of the invention, the additive formulation may additionally comprise any one or more of a stabilizer, a biocide, and a buffer.

In an embodiment of the invention, a formulation that is a full formulation for use in a reduced temperature dairy equipment cleaning operation comprises the alkalinity agent. In other embodiments of the invention, the cleaning solutions comprise another alkalinity agent.

In certain embodiments of the invention, the full formulation may comprise from about 41.5 wt % to about 81 wt % of a product stabilization solvent, from about 4 wt % to about 6 wt % of a degreaser emulsifier solvent, from about 4.5 wt % to about 12 wt % of a hydrotrope, from about 2.25 wt % to about 27 wt % of a sequestrant, from about 0.75 wt % to about 2.5 wt % of a surfactant and from about 7.5 wt % to about 11 wt % of an alkalinity agent all by weight of the formulation. Further pursuant to this embodiment of the invention, the product stabilization solvent comprises water; the degreaser/emulsifier solvent comprises at least one of an alcohol and a glycol and, in a preferred embodiment of the invention, a dipropylene glycol methyl ether; the hydrotrope comprises any one or more of a salt of cumene sulfonic acid, a salt of xylene sulphonic acid, a glycolic acid and a salt of a fatty acid; the sequestrant comprises any one or more of an ethylene diamine tetraacetic acid (EDTA), a methylglycine diacetic acid (MGDA) and a poly(acrylic acid) (PAA) (M=4.5 k); the surfactant comprises any one or more of an alcohol alkoxylate that includes an ethylene oxide/propylene oxide (EO/PO) and an alcohol alkoxylate that includes an ethylene oxide/butylene oxide (EO/BO); and the alkalinity agent comprises any one or more of a caustic soda (NaOH), a soda ash ($NaCO_3$) and caustic potash (KOH). Of course, other solvents, degreaser/emulsifiers, hydrotropes, sequestrants and surfactants known in the art may be included in the formulations of the invention.

In certain embodiments of the invention, either the additive formulation or the full formulation may additionally comprise any one or more of a stabilizer, a biocide, and a buffer.

An aspect of the invention provides a cleaning solution for use in a cleaning operation for dairy equipment. According to one embodiment of the invention, the cleaning solution comprises from about 0.10 wt % to about 0.50 wt %, from about 0.10 wt % to about 0.30 wt %, from about 0.10 wt % to about 0.25 wt % or, preferably from about 0.15 wt % to about 0.20 wt % of an additive formulation of the invention all by weight of the cleaning solution. Further pursuant to this embodiment of the invention, the cleaning solution additionally comprises from about 0.05 wt % to about 0.50 wt %, from about 0.10 wt % to about 0.35 wt %, or, preferably, from about 0.15 wt % to about 0.25 wt % of an alkalinity agent all by weight of the cleaning solution. In certain embodiments of the invention, a weight ratio of an additive formulation to an alkalinity agent in the cleaning solution is from about 5:1 to about 1:5, from about 1:1 to about 2:5, or, preferably, from about 3:4 to about 1:2.

In another embodiment of the invention, the cleaning solution comprises from about 0.50 wt % to about 5.00 wt %, from about 1.00 wt % to about 2.00 wt % or, preferably, from about 1.50 wt % to about 2.00 wt % of a full formulation of the invention all by weight of the cleaning solution.

In yet another aspect, the invention provides a method of cleaning dairy processing equipment using any formulation of the invention. The method may also include the steps of combining the any additive formulation of the invention and an alkalinity agent in water to form a cleaning solution, injecting the cleaning solution in the dairy processing equipment to be cleaned, and raising the temperature of the water of the cleaning solution to less than about 50° C. In certain, preferred embodiments of the invention, the temperature of the water of the cleaning solution is raised to less than about 40° C. Alternatively, any full formulation of the invention, may itself be combined with water to form a cleaning solution. Including an alkalinity agent in the cleaning solution in addition to the alkalinity agent in the full formulation is optional.

The method of the invention may also comprise the steps of holding the cleaning solution in the dairy processing equipment for a rinse time needed to achieve a desired extent of soil removal, and discharging the cleaning solution from the dairy processing equipment. Other aspects and embodiments will become apparent upon review of the following description. The invention, though, is pointed out with particularity by the included claims.

DETAILED DESCRIPTION OF THE INVENTION

The present invention now will be described more fully hereinafter. Preferred embodiments of the invention may be described, but this invention may, however, be embodied in many different forms and should not be construed as limited to the embodiments set forth herein. Rather, these embodiments are provided so that this disclosure will be thorough and complete, and will fully convey the scope of the invention to those skilled in the art. The embodiments of the invention are not to be interpreted in any way as limiting the invention.

As used in the specification and in the appended claims, the singular forms "a", "an", and "the" include plural referents unless the context clearly indicates otherwise. For example, reference to "a sequestrant" includes a plurality of such sequestrants.

Although specific terms are employed herein, they are used in a generic and descriptive sense only and not for purposes of limitation. All terms, including technical and scientific terms, as used herein, have the same meaning as commonly understood by one of ordinary skill in the art to which this invention belongs unless a term has been otherwise defined. It will be further understood that terms, such as those defined in commonly used dictionaries, should be interpreted as having a meaning as commonly understood by a person having ordinary skill in the art to which this invention belongs. It will be further understood that terms, such as those defined in commonly used dictionaries, should be interpreted as having a meaning that is consistent with their meaning in the context of the relevant art and the present disclosure. Such commonly used terms will not be interpreted in an idealized or overly formal sense unless the disclosure herein expressly so defines otherwise.

An aspect of the invention described herein relates to a formulation for use in cleaning of equipment that has been used to transport and/or process dairy products. In particular, the formulations of the invention allow for such cleaning operations to operate at a temperature that is lower than the temperature conventionally used in such cleaning operations. In an embodiment of the invention, the formulation generally comprises a sequestrant, a surfactant and an alkalinity agent. Without being bound by the theory, the concentration of the alkalinity agent in the mixed cleaning solution used to clean the equipment allows for a reduced temperature at which the cleaning may occur. The inventors have found that such effective cleaning may be accomplished by combining an appropriately reduced temperature and alkalinity.

Certain formulations of the invention are directed to equipment, in particular, dairy processing equipment, that has not been operated at a higher temperature such that the surfaces of the dairy processing equipment are substantially free of burnt-in soil.

While other functional compounds may be included in the formulation, at least a sequestrant; optionally, a surfactant; and an alkalinity agent will be a part of the mixed cleaning solution. For example, in certain embodiments of the invention, the formulation may additionally comprise a solvent, a sequestrant or chelating agent and a surfactant. In further embodiments of the invention, the formulation may comprise a hydrotrope.

According to certain embodiments of the invention, the formulation may also comprise a stabilizer. According to certain embodiments of the invention, the formulation may also comprise a biocide. According to certain embodiments of the invention, the formulation may also comprise a buffer. In certain embodiments of the invention, the alkalinity agent will be mixed with the formulation in the mixed cleaning solution. Pursuant to these embodiments of the invention, the formulation is otherwise known herein as an additive formulation. In preferred embodiments of the invention, the formulation comprises an alkalinity agent. Pursuant to these embodiments of the invention, the formulation is otherwise known herein as a full formulation. In certain embodiments of the invention, the formulation may include an alkalinity agent and an alkalinity agent may additionally be included in the mixed cleaning solution.

As used herein, the term "alkalinity agent" means a compound or other solution intended to alkalinize the mixed solution or raise the pH of the solution to which the alkalinity agent is applied. For example, either $OH^-$ or $CO_3^{2-}$ ions may increase the alkalinity of the mixed solution. Alkalinity agents of the invention may include one or any combination of sodium hydroxide (NaOH), caustic potash or potassium hydroxide (KOH), soda ash, sodium carbonate ($Na_2CO_3$) or sodium bicarbonate ($NaHCO_3$). In preferred embodiments of the invention, caustic soda and/or soda ash and/or caustic potash are used as the alkalinity agent. The concentration of the alkalinity agent may be varied in tandem with the concentration of the formulation of the invention to change the effect the alkalinity agent has, not only with respect to a change in alkalinity of the formulation itself but also with enhanced cleaning performance. The enhanced cleaning performance may result from any one or more of solubility of the formulation and alkalinity agent itself and, perhaps, alkaline hydrolysis, which is otherwise known as saponification. In certain embodiments of the invention, the alkalinity agent is directly included within the formulation of the invention.

In an embodiment of the invention, the formulation is an additive to include with an alkalinity agent for the cleaning operation and does not comprise an alkalinity agent as part of the formulation and is referred to as an "additive formulation" herein. In other embodiments of the invention, the formulation includes an alkalinity agent for the cleaning operation and is referred to as a "full formulation" herein. In yet other embodiments of the invention, in addition to the use of a full formulation, an alkalinity agent may additionally be included with the full formulation in the cleaning operation.

As used herein, the term "biocide" means a compound or other solution intended to destroy, deter, render pests, bacterial species, fungi and viruses harmless, preventing the action or fight in any other manner by chemical or biological means. Biocides also include antimicrobial agents that are disinfectants or sanitizers.

As used herein, the term "buffer" means a compound that maintains the pH of the formulation within a narrow range of limits. A buffer included in the formulation of the invention maintains a pH in a desired alkaline range.

As used herein, the term "enzyme" may catalyze the breakdown of proteinaceous materials that have become deposited on the surface of equipment. It is not favored to use any such enzymes at higher temperatures—typically above 60° C. —since enzymes are susceptible to breakdown at these higher temperatures. It is more preferable to use enzymes for cleaning at the reduced temperature of the invention, even more preferably, in the range of from about 40° C. to about 50° C. Proteases (break down protein), amylases (break down starch) and lipases (break down fats) are the most commonly used types of enzymes in cleaning systems.

As used herein, the term "hydrotrope" means a compound that helps other compounds become dissolved in a solvent. Due to this action, a hydrotrope may also be known as a solubilizer. Hydrotropy is a property that relates to the ability of a material to improve the solubility or miscibility of a substance in liquid phases where such substance tends to be only partly soluble or even insoluble altogether. Without being limited to a particular theory, a hydrotrope modifies a formulation to increase the solubility of an insoluble substance. Such combinations more favorably create micellar or mixed micellar formulations resulting in a stable emulsion or suspension of the partly soluble or insoluble substance. Certain hydrotropes may also have a surfactant type quality. Similar to surfactants, hydrotropes may be polar (hydrophilic) or non-polar (hydrophobic) in nature.

As used herein, "reduced temperature" means a temperature at which a dairy equipment cleaning operation using the formulation of the invention is operated and is lower than temperatures conventionally used for such dairy equipment cleaning operations. For example, conventional temperatures for a dairy equipment cleaning operation may be from about 60° C. to about 120° C., from about 65° C. to about 100° C. or from about 70° C. to about 85° C., while the reduced temperature for the dairy equipment cleaning operation using the formulation of the invention may be from about 30° C. to about 60° C., from about 35° C. to about 55° C. or from about 40° C. to about 50° C. In certain embodiments of the invention, the reduced temperature of the dairy equipment cleaning operation using the formulation of the invention is less than about 50° C. In preferred embodiments of the invention, the reduced temperature of the dairy equipment cleaning operation using the formulation of the invention is less than about 40° C.

As used herein, the term "sequestrant" means a compound capable of isolating or inactivating a metal ion that may be present in the solution by developing a complex that prevents the metal ion from readily participating in or catalyzing chemical reactions. A sequestrant may also function as a threshold agent by delaying or even preventing crystal growth or crystallization. The terms "chelant" or "chelating agent" may also be used interchangeably with the term "sequestrant" in the disclosure provided herein. A sequestrant, chelant or chelating agent complex with certain metal ions that may otherwise serve to reduce the effectiveness of any surfactant included in the formulation. For example, water present in the equipment for cleaning purposes may include calcium cations ($Ca^{2+}$) and magnesium cations ($Mg^{2+}$) that determine the hardness of the water. A sequestrant may be included that complex with $Ca^{2+}$ and $Mg^{2+}$ metal ions to prevent their interference with the activity of a surfactant.

In addition to a sequestrant providing improved control of water hardness, a sequestrant will assist with the control of dissolve fats. In a non-limiting example, sodium stearate is soluble in water that will cause the stearate to remain in the solution. However, upon saponification, calcium stearate may instead be formed, which is largely insoluble in water and cannot be rinsed from the solution causing. Thus a sequestrant avoids such formation of calcium stearate.

As used herein, the term "solvent" is a solution included to one or more of provided product stabilization solvent and act as degreaser/emulsifier. Degreaser/emulsifier solvents, for example but without intending to be bound by the theory, may be included to dissolve ingredients that the product stabilization solvent cannot. It is preferred that a degreaser/emulsifier solvent is miscible with an included product stabilization solvent. The combined action of both types of solvents leads to a more uniform composition with the formulations of the invention. Exemplary degreaser/emulsifier solvents include an alcohol and a glycol, separate or in combination. Specific exemplary degreaser/emulsifier solvents include, but are not limited to, one or more of an alcohol, a glycerin and an ether. More specific exemplary degreaser/emulsifier solvents include, but are not limited to a glycol ether, an oil, a fatty acid, an alkane, a terpene, a ketone, toluene or derivative thereof, a dipropylene glycol methyl ether, and any combination thereof.

As used herein, the term "stabilizer" means a compound that is capable of imparting a chemical stability to the formulation protecting the other compounds included in the formulation so that they can be allowed to perform their desired function.

As used herein, the term "surfactant" means a the active cleaning agent of a formulation that may perform any combination of wetting and even penetrating the surface of the equipment to be cleaned, loosening deposited soils at the surface of the equipment, and emulsifying the soils to keep them suspected in solution for removal from the equipment. Surfactants tend to also reduce the surface tension in the formulation. Surfactants may be selected that are polar or hydrophilic in nature, such as negatively charged or anionic surfactants or positively charged or cationic surfactants, and become attracted to any water in solution. Surfactants may be selected that are non-polar or hydrophobic in nature, such as nonionic surfactants having no charge, that, while suspended in water, still are attracted to non-water based components that are present in solution. While surfactants may include a combination of polar and non-polar-based surfactants, in preferred embodiments of the invention the surfactant is a nonionic surfactant. Without intending to be bound by the theory, nonionic surfactants provide improved cleaning performance at a temperature that is just below or approaching the cloud point temperature of the nonionic surfactant. In certain embodiments of the invention, without intending to be bound by the theory, the temperature is above the cloud point temperature of the surfactant to prevent foaming of the solution.

Conventionally, surfactants have been chosen in cleaning formulations for a particular temperature of use. The surfactant of the formulation of the invention is chosen such that the cloud point temperature of the surfactant is below the desired reduced temperature of the cleaning operation. In certain embodiments of the invention, a plurality of surfactants are chosen such that the surfactants have staggered cloud point temperatures allowing the formulation to be effective over a broader temperature range. Indeed, the surfactant or combination of surfactants may be such that it is more favorable to conduct the cleaning operation at a reduced temperature because cleaning operations using the formulation of the invention at temperatures greater than this reduced temperature are not as effective.

Amphoteric surfactants are well known in the art. An amphoteric surfactant is a surfactant that simultaneously carries an anionic and a cationic hydrophilic group with its structure containing simultaneously hermaphroditic ions which are able to form cation or anion according to the conditions of the solution. Such conditions may include, for example, without intending to be limiting, a pH change, a temperature change, and/or a change in presence or concentration of a compound in solution. Non-limiting examples of amphoteric surfactants include alkyl amine oxide, an N-alkylamino propionic acid, an N-alkyl-β-imino dipropionic acid, an imidazoline carboxylate, an alkyl betaine, an alkyl amido amine, an alkyl amido betaine, an alkyl sultaine, an alkyl amphodiacetate, an alkyl amphoacetate, an alkyl sulfobetaine, a polymeric sulfobetaine, an amphohydroxypropylsulfonate, a phosphatidylcholine, a phosphatidylethanolamine, a phosphatidylserine, a sphingomyelin, an alkyl amidopropyl phosphatidyl PG-dimonium chloride, or any combination thereof. In certain embodiments of the invention, the alkyl group in the amphoteric surfactant may have an average carbon length of from about C6 to about C22. Preferred amphoteric surfactants for the formulation of the invention include an alkyl amino propionate such as an alkyl amino dipropionate, and any salt thereof, such as, for example alkyl amino dipropionate mono Na salt. The alkyl group in the preferred amphoteric surfactant may have an average carbon length of about C6 to about C10, and about C8.

In an embodiment of the invention either one or more surfactants that function as a hydrotrope may be included with another hydrotrope or act entirely on their own as a hydrotrope. These one or more surfactants are also otherwise known herein as a hydrotrope functional surfactant. In an embodiment of the invention, the one or more hydrotrope functional surfactants may comprise from about 0.1 wt % to about 20 wt %, from about 0.2 wt % to about 15 wt %, from about 0.25 wt % to about 10 wt %, from about 0.4 wt % to about 7.5 wt %, from about 0.5 wt % to about 5 wt %, from about 0.7 wt % to about 2.5 wt %, or from about 0.75 wt % to about 1 wt %. In certain embodiments of the invention, the amphoteric surfactant may act as a hydrotrope in a formulation. In certain other embodiments of the invention, the selected amphoteric surfactant may replace another compound that otherwise acts as a hydrotrope in the invention. In certain other embodiments of the invention another type of surfactant may be chosen to act in similar fashion as a hydrotrope. Further pursuant to this embodiment of the invention, a nonionic surfactant may be chosen to act as a hydrotrope. A non-limiting example of a compound that may be chosen to act as a hydrotrope includes alkyl polyglucoside wherein the alkyl group comprises an average carbon chain length of about C8 to about C10. In yet other embodiments of the invention, a combination of an amphoteric surfactant and a nonionic surfactant may be chosen to act as a hydrotrope even replacing altogether another compound that is a hydrotrope within the formulation. In a preferred embodiment of the invention, a combination of an alkyl amino propionate such as an alkyl amino dipropionate and an alkyl polyglucoside such as an alkyl polyglycoside may be chosen to function as a hydrotrope within a formulation. In more specific embodiments of the invention, the alkyl group in the preferred amphoteric surfactant may have an average carbon length of about C6 to about C10, and about C8, and the alkyl group in the alkyl polyglucoside comprises an average carbon chain length of about C8 to about C10.

An aspect of the invention provides a formulation having a sequestrant and a surfactant. In certain embodiments of the invention, the formulation may be an additive formulation where an alkalinity agent is mixed with the additive formulation in the mixed cleaning solution. In certain other embodiments of the invention, the formulation may be a full formulation where an alkalinity agent is included in the formulation. In yet other embodiments of the invention, the formulation may include an alkalinity agent while another alkalinity agent is included with such a formulation in the mixed cleaning solution.

Sequestrants that may be used in the formulation of the invention include certain phosphates such as sodium tripolyphosphate (STPP), tetrasodium pyrophosphate, hexametaphosphate, tetrapotassium pyrophosphate, hydroxyl ethylidene diphosphonic acid (HEDP), and amino tri (methylene phosphonic acid) (ATMP). Other non-phosphate sequestrants that may be used in the formulation of the invention include citrates, tartrates, succinates, gluconates, polycarbonates, ethylenediamine tetraacetic acid (EDTA), diethylene triamine pentaacetic acid (DTPA), hydroxyethylene diamine triacetic acid (HEDTA), dihydroxyethyle glycine (DEG), triethanolamine, methylglycine diacetic acid (MGDA), glutamate diacetate (GLDA), nitrilotriacetic acid (NTA), and polyacrylates. Any combination of these identified sequestrants may be included in the formulation having a total concentrations in the ranges identified herein.

In an embodiment of the invention, the surfactant of the formulation comprises at least one of an alcohol alkoxylate that includes an ethylene oxide/propylene oxide (EO/PO) and an alcohol alkoxylate that includes an ethylene oxide/butylene oxide (EO/BO) in the concentration ranges identified herein. In certain embodiments of the invention, the alcohol alkoxylates have a carbon chain length ranging from about 10 to about 18, from about 11 to about 17, from about 12 to about 16 or from about 13 to about 15.

An aspect of the invention provides a formulation having at least one of a product stabilization solvent and a degreaser emulsifier solvent, a hydrotrope, a sequestrant or chelating agent, and a surfactant. Optionally, the formulation may additionally comprise any one or more of a stabilizer, a biocide, and a buffer. An additive formulation of the invention, as defined herein, comprises these stated types of compounds and is combined with an alkalinity agent at the time of its use in the cleaning operation. A full formulation of the invention, as defined herein, additionally comprises an alkalinity agent in addition to these named compounds.

In an embodiment of the invention, the solvent of the formulation may comprise at least one of a product stabilization solvent and a degreaser/emulsifier solvent. In certain embodiments of the invention, the product stabilization solvent in an additive formulation is from about 40 wt % to about 90 wt %, from about 40 wt % to about 82.5 wt %, from about 53 wt % to about 75 wt %, or from about 53.5 wt % to about 60 wt % all by weight of the formulation on an alkalinity agent-free basis. In other embodiments of the invention, the product stabilization solvent in a full formulation is from about 28.5 wt % to about 89.5 wt %, from about 41.5 wt % to about 81 wt %, from about 50 wt % to about 80 wt %, or from about 50 wt % to about 70 wt % all by weight of the formulation. In certain other embodiments of the invention, the formulation comprise up to about 93.7 wt % of the product stabilization solvent.

In certain embodiments of the invention, the degreaser/emulsifier solvent in an additive formulation is from about 2 wt % to about 12 wt %, from about 3 wt % to about 11 wt %, from about 4 wt % to about 10 wt %, or from about 8 wt % to about 10 wt % all by weight of the formulation on an alkalinity agent-free basis. In other embodiments of the invention, the use of a degreaser/emulsifier solvent may be optional. Further pursuant to the embodiment of a full formulation that includes a degreaser/emulsifier solvent, a concentration of such solvent is from about 1 wt % to about 10 wt %, from about 2 wt % to about 8 wt %, from about 4 wt % to about 6 wt %, or from about 4.5 wt % to about 5.5 wt % all by weight of the formulation.

In an embodiment of the invention, the product stabilization solvent of the formulation comprises water in the concentration ranges identified herein. In other embodiments of the invention, the degreaser/emulsifier solvent of the formulation comprises at least one of an alcohol and a glycol and, in a preferred embodiment of the invention, a dipropylene glycol methyl ether in the concentration ranges identified herein. In certain embodiments of the invention, the additive formulation of the invention may comprise any combination of water and at least one of an alcohol and a glycol and, in a preferred embodiment of the invention, a dipropylene glycol methyl ether in the concentration ranges disclosed herein. In certain other embodiments of the invention, the full formulation of the invention may comprise any combination of water and at least one of an alcohol and a glycol and, in a preferred embodiment of the invention, a dipropylene glycol methyl ether in the concentration ranges disclosed herein.

In an embodiment of the invention, an additive formulation comprises a hydrotrope having a concentration of from about 4 wt % to about 30 wt %, from about 5 wt % to about 25 wt %, from about 5.5 wt % to about 22 wt %, or from about 5.5 wt % to about 20 wt % all by weight of the formulation on an alkalinity agent-free basis. In another embodiment of the invention, a full formulation comprises a hydrotrope having a concentration of from about 1 wt % to about 20 wt %, from about 2 wt % to about 15 wt %, from about 4 wt % to about 13 wt %, or from about 4.5 wt % to about 12 wt % all by weight of the formulation.

In certain preferred embodiments of the invention, the hydrotrope comprises any one or more of salt of cumene sulfonic acid, salt of xylene sulphonic acid, glycolic acid and a salt of a fatty acid. In certain embodiments of the invention, an additive formulation comprises from about 4 wt % to about 25 wt %, from about 5 wt % to about 20 wt %, or from about 5.5 wt % to about 16 wt % of a salt of cumene sulfonic acid all by weight of the formulation on an alkalinity agent-free basis. In other embodiments of the invention, a full formulation comprises from about 1 wt % to about 10 wt %, from about 2 wt % to about 6 wt %, or from about 4 wt % to about 5 wt % of a salt of cumene sulfonic acid all by weight of the formulation.

In certain embodiments of the invention, an additive formulation comprises from about 4 wt % to about 25 wt %, from about 5 wt % to about 20 wt %, from about 5.5 wt % to about 15 wt % or from about 10 wt % to about 14.5 wt % of a salt of xylene sulphonic acid all by weight of the formulation on an alkalinity agent-free basis. In other embodiments of the invention, a full formulation comprises from about 5 wt % to about 15 wt %, from about 6 wt % to about 14 wt %, from about 7 wt % to about 13 wt % or from about 10 wt % to about 12 wt % of a salt of xylene sulphonic acid all by weight of the formulation. In certain embodiments of the invention, an additive formulation comprises from about 1 wt % to about 15 wt %, from about 2 wt % to about 10 wt %, from about 5 wt % to about 8 wt %, or from about 5.6 wt % to about 7 wt % of glycolic acid all by weight of the formulation on an alkalinity agent-free basis.

In certain embodiments of the invention, the additive formulation of the invention may comprise any combination of salt of cumene sulfonic acid, salt of xylene sulphonic acid and/or glycolic acid in the concentration ranges disclosed herein. In certain embodiments of the invention, the full formulation of the invention may comprise any combination of salt of cumene sulfonic acid, salt of xylene sulphonic acid and/or glycolic acid in the concentration ranges disclosed herein.

In an embodiment of the invention, an additive formulation comprises a sequestrant or chelating agent having a concentration of from about 2.5 wt % to about 40 wt %, from about 3 wt % to about 35 wt %, from about 3 wt % to about 32 wt %, or from about 3 wt % to about 12 wt % all by weight of the formulation on an alkalinity agent-free basis. In another embodiment of the invention, a full formulation comprises a sequestrant or chelating agent having a concentration of from about 1.5 wt % to about 35 wt %, from about 2 wt % to about 30 wt %, from about 2.25 wt % to about 27 wt %, or from about 2.25 wt % to about 3 wt % or from about 27 wt % to about 28 wt % all by weight of the formulation.

In certain preferred embodiments of the invention, the sequestrant comprises any one or more of ethylene diamine tetraacetic acid (EDTA), methylglycine diacetic acid (MGDA) and poly(acrylic acid) (PAA) (M=4.5 k). In certain embodiments of the invention, an additive formulation comprises from about 1 wt % to about 35 wt %, from about 2 wt % to about 30 wt %, from about 2.5 wt % to about 30 wt %, or from about 2.5 wt % to about 10 wt % of EDTA all by weight of the formulation on an alkalinity agent-free basis. In other embodiments of the invention, a full formulation comprises from about 1 wt % to about 30 wt %, from about 1.5 wt % to about 28 wt %, from about 2 wt % to about 26 wt %, or from about 1.5 wt % to about 2.5 wt % or from about 25 wt % to about 27 wt % of EDTA all by weight of the formulation.

In certain embodiments of the invention, an additive formulation comprises from about 0.5 wt % to about 5 wt %, from about 1 wt % to about 3 wt %, or from about 1.5 wt % to about 2.5 wt % of MGDA all by weight of the formulation on an alkalinity agent-free basis. In certain embodiments of the invention, an additive formulation comprises from about 0.25 wt % to about 5 wt %, from about 0.5 wt % to about 3 wt %, or from about 0.6 wt % to about 2.25 wt % of PAA (M=4.5 k) all by weight of the formulation on an alkalinity agent-free basis. In other embodiments of the invention, a full formulation comprises from about 0.1 wt % to about 4 wt %, from about 0.2 wt % to about 3 wt %, from about 0.3 wt % to about 1 wt % or from about 0.4 wt % to about 0.6 wt % of PAA (M=4.5 k) all by weight of the formulation.

In certain embodiments of the invention, the additive formulation of the invention may comprise any combination of EDTA, MGDA and/or PAA in the concentration ranges disclosed herein. In certain embodiments of the invention, the full formulation of the invention may comprise any combination of EDTA, MGDA and/or PAA in the concentration ranges disclosed herein.

The formulation of the invention, even in certain preferred embodiments, may additionally comprise a compound having both a sequestrant or chelating property as well as a hydrotrope property. A non-limiting exemplary compound having both these properties includes glycolic acid. In an embodiment of the invention, an additive formulation comprises from about 1 wt % to about 15 wt %, from about 2 wt % to about 10 wt %, from about 5 wt % to about 8 wt %, or from about 5.6 wt % to about 7 wt % of glycolic acid all by weight of the formulation on an alkalinity agent-free basis. In an embodiment of the invention, a full formulation comprises from about 0.5 wt % to about 10 wt %, from about 1 wt % to about 9 wt %, from about 2 wt % to about 8 wt %, from about 3 wt % to about 6 wt % or from about 4 wt % to about 5 wt % of glycolic acid all by weight of the formulation.

In an embodiment of the invention, an additive formulation comprises a surfactant having a concentration of from about 0.5 wt % to about 20 wt %, from about 1 wt % to about 15 wt %, from about 1 wt % to about 16 wt %, or from about 1 wt % to about 18 wt % all by weight of the formulation on an alkalinity agent-free basis. In another embodiment of the invention, a full formulation comprises a surfactant having a concentration of from about 0.5 wt % to about 10 wt %, from about 0.75 wt % to about 5 wt %, from about 0.75 wt % to about 2.5 wt %, or from about 1 wt % to about 2 wt % all by weight of the formulation.

In an embodiment of the invention, an additive formulation may comprise from about 1 wt % to about 8 wt %, from about 2 wt % to about 7 wt %, from about 3 wt % to about 6 wt %, or from about 4 wt % to about 5 wt % of an alcohol alkoxylate that includes an EO/PO all by weight of the formulation on an alkalinity agent-free basis. In another embodiment of the invention, a full formulation may comprise from about 0.5 wt % to about 7 wt %, from about 1 wt % to about 6 wt %, from about 2 wt % to about 5 wt %, or from about 3 wt % to about 4 wt % of an alcohol alkoxylate that includes an EO/BO all by weight of the formulation.

In another embodiment of the invention, an additive formulation may comprise from about 0.5 wt % to about 15 wt %, from about 0.75 wt % to about 12 wt %, from about 1 wt % to about 11 wt %, or from about 1.15 wt % to about 10 wt % of an alcohol alkoxylate that includes an EO/PO all by weight of the formulation on an alkalinity agent-free basis. In a preferred embodiment of the invention, a full formulation may comprise from about 0.5 wt % to about 5 wt %, from about 0.75 wt % to about 4 wt %, from about 1 wt % to about 3 wt %, or from about 1 wt % to about 2 wt % of an alcohol alkoxylate that includes an EO/PO all by weight of the formulation.

In an embodiment of the invention, an additive formulation may comprise a stabilizer having a concentration of from about 0.05 wt % to about 0.5 wt %, from about 0.1 wt % to about 0.4 wt %, from about 0.15 wt % to about 0.3 wt %, or from about 0.2 wt % to about 0.25 wt % all by weight of the formulation on an alkalinity agent-free basis. In an embodiment of the invention, the stabilizer of the formulation comprises urea. Without intending to be bound by the theory, urea functions as an antioxidant in the event the cleaning operation has nitric acid. In an embodiment of the invention, a full formulation may comprise a stabilizer having a concentration of from about 0.04 wt % to about 0.4 wt %, from about 0.05 wt % to about 0.3 wt %, from about 0.1 wt % to about 0.25 wt %, or from about 0.15 wt % to about 0.2 wt % all by weight of the formulation.

In an embodiment of the invention, an additive formulation may comprise a biocide having a concentration of from about 0.5 wt % to about 12 wt %, from about 1 wt % to about 11 wt %, from about 2 wt % to about 10 wt %, from about 3 wt % to about 9.5 wt % or from about 4 wt % to about 8.5 wt % all by weight of the formulation on an alkalinity agent-free basis. In an embodiment of the invention, the biocide of the formulation comprises dodecyl dipropylene triamine.

A full formulation may optionally include a biocide. Further pursuant to an embodiment where the full formulation does include a biocide, such biocide has a concentration of from about 1 wt % to about 10 wt %, from about 2 wt % to about 10 wt %, from about 4 wt % to about 9 wt %, from about 6 wt % to about 8 wt % or from about 6.5 wt % to about 7.5 wt % all by weight of the formulation. In certain preferred embodiments of the invention, a full formulation does not include a biocide.

In an embodiment of the invention, an additive formulation may comprise a buffer having a concentration of from about 0.5 wt % to about 6 wt %, from about 1 wt % to about 5 wt %, from about 2 wt % to about 4.5 wt % or from about 3 wt % to about 4 wt % all by weight of the formulation on an alkalinity agent-free basis. In an embodiment of the invention, a full formulation may comprise a buffer having a concentration of from about 1 wt % to about 7 wt %, from about 2 wt % to about 6 wt %, from about 2.5 wt % to about 5 wt % or from about 3 wt % to about 4 wt % all by weight of the formulation. In an embodiment of the invention, the buffer of the formulation comprises sodium carbonate.

Further pursuant to the embodiment where the formulation is an additive formulation, a ratio by weight of the additive formulation to alkalinity agent is from about 3:1 to about 1:5, from about 5:1 to about 1:5, from about 2:1 to about 1:4, preferably, from about 2:1 to about 1:3, more preferably, from about 2:1 to about 2:3, from about 3:2 to about 2:3 or from about 1:1 to about 3:4. In an embodiment of the invention, an alkalinity agent to be used with the additive formulation comprises any one or more of a hypochlorite, a caustic soda, a soda ash and a caustic potash. In a preferred embodiment of the invention, the alkalinity agent comprises caustic soda.

Further pursuant to the embodiment where the formulation is a full formulation, the full formulation comprises an alkalinity agent having a concentration of from about 3 wt % to about 20 wt %, from about 5 wt % to about 15 wt %, from about 6 wt % to about 12 wt %, from about 7.5 wt % to about 11 wt % or from about 8.5 wt % to about 10 wt % all by weight of the formulation. In certain embodiments of the invention, a weight ratio of the non-alkalinity agent compounds in the full formulation to the alkalinity agent included in the full formulation is from about 13:1 to about 7:1, from about 12:1 to about 8:1, from about 11:1 to about 9:1 or from about 11:1 to about 10:1.

In an embodiment of the invention, the alkalinity agent of the full formulation comprises at least one of a caustic soda (NaOH), a soda ash ($NaCO_3$) and a caustic potash (KOH). In an embodiment of the invention, a full formulation may comprise from about 3 wt % to about 20 wt %, from about 5 wt % to about 15 wt %, from about 8 wt % to about 12 wt %, from about 9 wt % to about 11 wt %, from about 9.5 wt % to about 10.5 wt % or from about 5 wt % to about 10 wt % of a sodium hydroxide all by weight of the formulation. In an embodiment of the invention, a full formulation may comprise from about 1 wt % to about 10 wt %, from about 1.5 wt % to about 7.5 wt %, or from about 2 wt % to about 5 wt % of a sodium carbonate all by weight of the formulation. In an embodiment of the invention, a formulation may comprise up to about 40 wt % or up to about 50 wt % of an alkalinity agent. In certain embodiments of the invention, the full formulation may comprise any combination of sodium hydroxide and sodium carbonate in the concentration ranges disclosed herein.

Without intending to be bound by theory, while higher concentrations of the alkalinity agent in a mixed cleaning solution using a full formulation of the invention is desired, it may not be possible to get the desired amount of alkalinity agent in the full formulation to deliver such higher concentration in the cleaning solution. E.g., crystallization or other effects may not make it possible. Thus such higher concentrations in the range for from about 0.2 wt % to about 0.5 wt % of the alkalinity agent in the cleaning solution may be achieved by using the full formulation with the same alkalinity agent or another alkalinity agent being directed added to the cleaning solution with the full formulation.

An additive formulation comprises from about 40 wt % to about 82.5 wt % or alternatively, from about 53.5 wt % to about 60 wt %, of a product stabilization solvent, from about 8 wt % to about 10 wt % of a degreaser emulsifier solvent, from about 5.5 wt % to about 20 wt % of a hydrotrope, from about 3 wt % to about 12 wt % of a sequestrant or chelating agent, and from about 1 wt % to about 18 wt % of a surfactant all by weight of the formulation on an alkalinity agent-free basis. Optionally, the formulation may additionally comprise any one or more of from about 0.15 wt % to about 0.3 wt % of a stabilizer, from about 4 wt % to about 8.5 wt % of a biocide, and/or 2 wt % to about 4.5 wt % of a buffer all by weight of the formulation on an alkalinity agent-free basis.

A full formulation comprises from about 41.5 wt % to about 81 wt %, or alternatively, from about 50 wt % to about 70 wt %, of a product stabilization solvent, from about 4 wt % to about 6 wt % of a degreaser emulsifier solvent, from about 4.5 wt % to about 12 wt % of a hydrotrope, from about 2.25 wt % to about 27 wt % of a sequestrant or chelating agent, from about 0.75 wt % to about 2.5 wt % of a surfactant and from about 7.5 wt % to about 11 wt % of an alkalinity agent all by weight of the formulation. Optionally, the formulation may additionally comprise any one or more of from about 0.1 wt % to about 0.25 wt % of a stabilizer, from about 6 wt % to about 8 wt % of a biocide, and/or 2.5 wt % to about 5 wt % of a buffer all by weight of the formulation.

An aspect of the invention provides a cleaning solution for use in a cleaning operation for dairy equipment. The cleaning operation of the dairy equipment, according to certain embodiments of the invention, is subjected to dairy processing equipment that has not been operated at a higher temperature such that the surfaces of the dairy processing equipment are substantially free of burnt-in soil.

In an embodiment of the invention, the cleaning solution comprises from about 0.05 wt % to about 0.50 wt %, from about 0.05 wt % to about 0.30 wt %, from about 0.10 wt % to about 0.30 wt %, from about 0.10 wt % to about 0.25 wt % or from about 0.15 wt % to about 0.20 wt % of an additive formulation of the invention all by weight of the cleaning solution. Further pursuant to this embodiment of the invention, the cleaning solution additionally comprises from about 0.05 wt % to about 0.60 wt %, from about 0.10 wt % to about 0.50 wt %, from about 0.10 wt % to about 0.35 wt % or from about 0.15 wt % to about 0.25 wt % of an alkalinity agent all by weight of the cleaning solution. In certain embodiments of the invention, a weight ratio of an additive formulation to an alkalinity agent in a cleaning solution is from about 3:1 to about 1:10, from about 2:1 to about 1:5, from about 3:2 to about 1:3, from about 1:1 to about 2:5 or from about 3:4 to about 1:2.

In another embodiment of the invention, the cleaning solution comprises from about 0.50 wt % to about 5.00 wt %, from about 0.50 wt % to about 3.00 wt %, from about 0.75 wt % to about 2.50 wt %, from about 1.00 wt % to about 2.00 wt % or from about 1.50 wt % to about 2.00 wt % of a full formulation of the invention all by weight of the cleaning solution. In certain embodiments of the invention, a weight ratio of the non-alkalinity agent compounds in the full formulation to the alkalinity agent included in the full formulation is from about 13:1 to about 7:1, from about 12:1 to about 8:1, from about 11:1 to about 9:1 or from about 11:1 to about 10:1.

Another aspect of the invention provides the use of the formulations of the invention in a CIP system or other equipment used for dairy processing. Without intending to be bound by the theory, the formulations of the invention useful in the cleaning of dairy processing equipment are capable of performing the needed cleaning operation at a reduced temperature providing for a cost savings in the amount of energy needed to perform the cleaning operation. In certain embodiments of the invention, the formulations of the invention do not include oxidizers, particularly chlorine-based oxidizers.

The method of the invention for cleaning a dairy processing equipment comprises the steps of providing a formulation having at least one of a product stabilization solvent and a degreaser emulsifier solvent, a hydrotrope, a sequestrant or chelating agent, and a surfactant. In one embodiment of the invention, the method includes combining the formulation and an alkalinity agent in water to form a cleaning solution, injecting the cleaning solution in the dairy processing equipment to be cleaned and raising the temperature of the water of the cleaning solution to about 40° C. to about 50° C., holding the cleaning solution in the dairy processing equipment for a wash time needed to achieve a desired extent of soil removal, and discharging the cleaning solution from the dairy processing equipment.

In an embodiment of the invention, the formulation additionally comprises an alkalinity agent and this formulation undergoes combining with water to form the cleaning solution. I.e., an alkalinity solution may or may not have to be combined with the water separately.

In an embodiment of the invention, the formulation may additionally comprise any one or more of a stabilizer, a biocide, and a buffer.

Any of the formulations disclosed herein may be used in the cleaning operations that are disclosed herein. In certain embodiments of the invention, the dairy processing equipment has not been operated at a higher temperature such that the surfaces of the dairy processing equipment are substantially free of burnt-in soil.

EXAMPLES

The invention is further defined by reference to the following examples, which describe formulations and methods for performing a reduced temperature cleaning of a dairy-based CIP operation according to the invention and the performance of such in a dairy equipment cleaning operation. Also included within these examples are comparative formulations known in the prior art and their performance in a reduced temperature cleaning of a dairy-based CIP operation.

In the following examples, the formulations were tested according to the following procedure: (1) clean the metal plates used in the experiments with deionized water and ethanol prior to their use; (2) number each of the plates with a permanent marker and obtain the weight of each of the plates on a balance; (3) soil a plate with 2 ml milk (having a fat concentration of 3.5 wt %); (4) dry the layer of soil by placing the soiled plate in a fume cabinet at room temperature; (5) repeat the soiling and drying to create a second layer on the first layer; (6) measure the weight of the dry soiled plate; (7) prepare 500 ml cleaning solution in a 600 ml beaker glass, place the beaker on a magnetic stirrer, and heat the solution to the temperature to be tested; (8) place the soiled plate into the cleaning solution and stir to create some mechanical interaction between the plate and the cleaning solution (stirring is consistently performed at the same speed of 200 rpm); (9) subject the plate to this for 10 min; (10) remove the plate from the solution and putting it aside to allow the plate to dry overnight; (11) take the final weight of the plate; and (12) calculate the percentage of cleaning performance by dividing the mass of the remaining soil by the mass of the original soil placed on the plate.

Example 1

Formulation 1 and Formulation 2 are defined in Table 1 and is exemplary of a formulation, otherwise described herein as an additive formulation, that is mixed in tandem with an alkalinity agent.

The concentration of the alkalinity agent included with each formulation is varied in tandem with the concentration of the formulation to identify the effect the alkalinity agent has not only with respect to the effect of a change in alkalinity on the formulation itself but also enhanced cleaning performance resulting from any one or more of solubility of the formulation and alkalinity agent itself and, perhaps, alkaline hydrolysis, which is otherwise known as saponification.

TABLE 1

| Compound | Function | Concentration, wt % Formulation 1 | Concentration, wt % Formulation 2 |
|---|---|---|---|
| water | product stabilization solvent | 57.8 | 59.8 |
| dipropylene glycol methyl ether | degreaser/emulsifier solvent | 10.0 | 8.0 |
| cumene sulfonic acid Na salt | hydrotrope | 6.0 | 16.0 |
| glycolic acid | sequestrant/hydrotrope | 7.0 | 5.6 |
| methylglycine diacetic acid | sequestrant or chelating agent | 2.0 | 2.0 |
| polyacrylic acid (M = 4.5k) | sequestrant or chelating agent | 2.2 | 1.8 |
| alcohol (C13-15) alkoxylate (EO/BO) | surfactant | 4.8 | 3.8 |
| alcohol (C13-15) alkoxylate (EO/PO) | surfactant | 10.0 | 3.0 |
| urea | stabilizer | 0.2 | 0.0 |

Formulation 1 is an exemplary formulation that includes a stabilizer - the urea.

For comparative purposes, Table 2 shows the reduction in soil removal based upon the use of NaOH as an alkalinity agent.

TABLE 2

| Agent | Concentration, wt % | Processing Temperature, ° C. | Soil Removal, % |
|---|---|---|---|
| NaOH | 0.50 | 40 | 40.4 |
| $HNO_3$ | 0.50 | 50 | 34.4 |

The results of the tests that include the formulations with the alkalinity agent are shown in Table 3.

First, Table 3 demonstrates that a comparable amount of a formulation and an alkalinity agent provides an improvement over the use of alkalinity agent alone as shown in Table 2. I.e., use of 0.20 wt % formulation with 0.30 wt % alkalinity agent has 81.6% and 74.2% soil removal, respectively for Formulation 1 and Formulation 2, in comparison to only a 40.4% soil removal for 0.5 wt % of the alkalinity agent alone.

Second, as can be seen in Table 3, diminishing returns in soil removal are realized by increasing the alkalinity agent relative to the formulation. In certain situations, it may be desirable to have an increased amount of alkalinity agent over the formulation in order to decrease the overall cost of treatment.

TABLE 3

| Concentration, wt % Formulation | Concentration, wt % Alkalinity Agent | Alkalinity Agent | Weight Ratio | Processing Temperature, ° C. | Soil Removal, % Formulation 1 | Soil Removal, % Formulation 2 |
|---|---|---|---|---|---|---|
| 0.20 | 0.10 | NaOH | 2:1 | 40 | 78.5 | 77.2 |
| 0.15 | 0.10 | NaOH | 3:2 | 40 | 76.7 | 70.0 |
| 0.10 | 0.10 | NaOH | 1:1 | 40 | 75.2 | 65.9 |
| 0.20 | 0.20 | NaOH | 1:1 | 40 | 86.7 | 90.6 |
| 0.15 | 0.20 | NaOH | 3:4 | 40 | 84.5 | 86.5 |
| 0.20 | 0.30 | NaOH | 2:3 | 40 | 81.6 | 74.2 |
| 0.10 | 0.20 | NaOH | 1:2 | 40 | 83.2 | 83.5 |
| 0.15 | 0.30 | NaOH | 1:2 | 40 | 73.1 | 69.1 |
| 0.20 | 0.50 | NaOH | 2:5 | 40 | 48.1 | 42.5 |
| 0.10 | 0.30 | NaOH | 1:3 | 40 | 70.5 | 67.2 |
| 0.10 | 0.50 | NaOH | 1:5 | 40 | 46.6 | 39.3 |

In these circumstances, the most economical optimum appears to be when the concentration of the formulation is about 0.1 wt % and the concentration of the alkalinity agent is about 0.2 wt % resulting in 1:2 weighted ratio of the formulation to the alkalinity agent.

In those instances where the highest soil removal is required notwithstanding the overall costs of the formulation, the maximum soil removal is realized with increasing use of the formulation. Based upon the data in Table 3, this is realized when the formulation concentration is about 0.2 wt % and the alkalinity agent concentration is about 0.2 wt % resulting in a 1:1 weighted ratio of the formulation to the alkalinity agent.

Additional testing was conducted on Formulation 2 to determine the extent of soil removal that could be achieved using an acidic agent instead of the alkalinity agent. The results of these tests are shown in Table 4.

TABLE 4

| Concentration, wt % | | | | Processing | Soil Removal, % |
|---|---|---|---|---|---|
| Formulation | Acidic Agent | Acidic Agent | Weight Ratio | Temperature, ° C. | Formulation 2 |
| 0.20 | 0.20 | $HNO_3$ | 1:1 | 40 | 34.4 |
| 0.20 | 0.50 | $HNO_3$ | 2:5 | 40 | 35.5 |

First there is not an appreciable increase in the amount of soil removal for the use of the formulation with an acidic agent (Table 4) versus the use of the acidic agent alone (Table 2). Additionally, the information in Table 3 shows that the use of an acid-based agent does not improve, but rather decreases, the extent of soil removal for Formulation 2 in comparison to being used with an alkalinity agent as shown in Table 3.

Example 2

Formulation 3, Formulation 4 and Formulation 5 are defined in Table 5.

Formulations 3, 4 and 5 are exemplary of formulations, otherwise described herein as a full formulation, which does not become mixed in tandem with an alkalinity agent. Rather, the alkalinity agent is itself included within the formulation.

Formulations 3 and 5 are exemplary of a formulation that includes a biocide—N,N-bis (3-aminopropyl) dodecylamine—and a buffer—the sodium carbonate. The use of Formulations 3 and 4 were first tested at varying concentrations and varying processing temperatures with the results shown in Table 6.

TABLE 5

| | | Concentration, wt % Formulation | | |
|---|---|---|---|---|
| Compound | Function | 3 | 4 | 5 |
| water | product stabilization solvent | 66.9 | 68.9 | 77.9 |
| dipropylene glycol methyl ether | degreaser/emulsifier solvent | 0.0 | 5.0 | 0.0 |
| cumene sulfonic acid Na salt | hydrotrope | 4.8 | 0.0 | 4.8 |
| xylene sulphonic acid Na salt | hydrotrope | 0.0 | 11.6 | 0.0 |
| ethylene diamine tetraacetic acid | sequestrant or chelating agent | 10.4 | 2.0 | 9.6 |
| polyacrylic acid (M = 4.5k) | sequestrant or chelating agent | 1.4 | 0.5 | 0.9 |
| alcohol (C13-15) alkoxylate (EO/PO) | surfactant | 1.0 | 2.0 | 0.0 |
| alcohol (C13-15) alkoxylate (EO/BO) | surfactant | 0.0 | 0.0 | 1.0 |
| alcohol (C13-15) alkoxylate (EO/BO) (methyl capped) | surfactant | 0.0 | 0.0 | 0.5 |
| N,N-bis (3-aminopropyl) dodecylamine | biocide | 7.0 | 0.0 | 0.4 |
| sodium carbonate | Buffer | 3.5 | 0.0 | 0.0 |
| sodium hydroxide | alkalinity agent | 5.0 | 10.0 | 5.0 |

As confirmed in Table 6, increasing concentrations of the full Formulation 3 as well as increased processing temperature results in greater soil removal. Without intending to be bound by the theory, the cost of the formulation in tandem with the savings associated with a reduction in energy will be determinative of the most optimum operating conditions for the use a full formulation.

TABLE 6

| Formulation | Concentration, wt % | Processing Temperature, ° C. | Soil Removal, % |
|---|---|---|---|
| 3 | 1.00 | 40 | 67.9 |
| | 1.00 | 50 | 73.1 |
| | 1.50 | 40 | 68.8 |
| | 1.50 | 50 | 80.9 |
| | 2.00 | 40 | 77.1 |
| | 2.00 | 50 | 85.8 |
| 4 | 1.00 | 40 | 78.8 |

Formulation 3, with the reduced cost of the formulation, also has relatively good soil removal capability at a reduced temperature.

Table 7 shows the effect of varying alkalinity concentration on soil removal using varying concentrations of Formulation 4 and Formulation 5. As shown in this table, the formulation includes an alkalinity agent included (NaOH in these examples), which may or may not be further supplemented through addition of the alkalinity agent.

TABLE 7

| Formulation | | NaOH, wt % | | Processing | Soil |
|---|---|---|---|---|---|
| Number | Concentration, wt % | w/Formulation | Added | Temperature, ° C. | Removal, % |
| 4 | 1.0 | 0.1 | 0.0 | 40 | 66.5 |
| 4 | 2.0 | 0.2 | 0.0 | 40 | 77.5 |
| 4 | 5.0 | 0.5 | 0.0 | 40 | 31.0 |
| 4 | 1.0 | 0.1 | 0.2 | 40 | 79.8 |
| 4 | 1.0 | 0.1 | 0.8 | 40 | 41.5 |
| 5 | 1.0 | 0.05 | 0.0 | 40 | 55.3 |
| 5 | 1.0 | 0.05 | 0.1 | 40 | 73.6 |
| 5 | 1.0 | 0.05 | 0.3 | 40 | 77.9 |
| 5 | 1.0 | 0.05 | 0.9 | 40 | 38.5 |
| 5 | 2.0 | 0.1 | 0.0 | 40 | 60.7 |
| 5 | 4.0 | 0.2 | 0.0 | 40 | 68.6 |
| 5 | 10.0 | 0.5 | 0.0 | 40 | 28.4 |

Without intending to be bound by the theory, the data in Table 7 shows that for soil removal (1) there is a diminishing return with increasing the concentration of alkalinity agent after a peak has been identified in the solution, (2) increased additions of an alkalinity agent with the formulation provides improved results, but again with eventual diminishing returns once a peak has been shown, and (3) increased concentration of the formulation will result in a reduced concentration of the alkalinity agent. At least with respect to Formulation 4 and Formulation 5, a concentration of alkalinity in the range of 0.2 to 0.4 seems to be preferred. Additionally, Table 7 shows that a balance between the concentration of the formulation and the concentration of the alkalinity agent, depending on overall costs, can be established.

Example 3

Comparative formulations that are additive formulations have been tested to determine their effectiveness of use in a reduced temperature dairy equipment cleaning operation. Table 8 identifies these comparative additive formulations.

The concentration of the alkalinity agent included with each of these comparative formulations is varied in tandem with the concentration of the formulation itself to identify the effect the alkalinity agent has not only with respect to the effect of a change in alkalinity on the formulation itself but also enhanced cleaning performance resulting from any one or more of solubility of the formulation and alkalinity agent itself and, perhaps, alkaline hydrolysis, which is otherwise known as saponification.

TABLE 8

| Compound | Function | Concentration, wt % Comparative Formulation 1 | 2 |
|---|---|---|---|
| water | product stabilization solvent | 40.8 | 79.8 |
| dipropylene glycol methyl ether | degreaser/emulsifier solvent | 13.7 | 12.0 |
| cumene sulfonic acid Na salt | hydrotrope | 21.9 | 0.0 |
| glycolic acid | sequestrant/hydrotrope | 9.6 | 0.0 |
| alcohol (C13-15) alkoxylate (EO/PO) | surfactant | 6.9 | 8.0 |
| alkyl (C8-12) propoxylate | surfactant | 6.9 | 0.0 |

For comparative purposes, Table 9 shows the reduction in soil removal based upon the use of NaOH as an alkalinity agent and $HNO_3$ as an acidic agent.

TABLE 9

| Concentration, wt % Formulation | Agent | Agent | Weight Ratio | Processing Temperature, ° C. | Soil Removal, % Comparative Formulation 1 | 2 |
|---|---|---|---|---|---|---|
| 0.20 | 0.50 | NaOH | 2:5 | 40 | — | 42.5 |
| 0.20 | 0.50 | $HNO_3$ | 2:5 | 40 | 37.9 | 37.2 |

As these results confirm, the use of an acidic agent in an additive formulation does not result in good soil removal at a reduced processing temperature. Even the use of a relatively larger amount of the alkalinity agent Comparative Formulation 2 does not result in good soil removal given the combination of compounds for the formulation.

Example 4

Acidic-based comparative formulations that are full formulations have been tested to determine their effectiveness of use in a reduced temperature dairy equipment cleaning operation. Comparative formulations having an acidic agent are identified in Table 10.

These comparative formulations were tested to, in part, determine the extent of soil removal that could be achieved using acidic agents instead of the alkalinity agent. The results of these tests are shown in Table 11. As these results confirm, the use of an acidic agent in a full formulation does not result in good soil removal at a reduced processing temperature.

Comparative formulations having an alkalinity agent, namely caustic soda or sodium hydroxide, are identified in Table 12.

TABLE 10

| Compound | Function | Concentration, wt % Comparative Formulation 3 | 4 | 5 |
|---|---|---|---|---|
| water | product stabilization solvent | 88.6 | 77.3 | 87.3 |
| cumene sulfonic acid Na salt | hydrotrope | 2.0 | 2.2 | 2.2 |
| alcohol (C13-15) alkoxylate (EO/BO) | surfactant | 1.0 | 0.5 | 1.1 |

TABLE 10-continued

| Compound | Function | Concentration, wt % Comparative Formulation 3 | 4 | 5 |
|---|---|---|---|---|
| polyoxyethylene octyl ether carboxylic acid | sequestrant or chelating agent | 0.9 | 0.5 | 1.0 |
| urea | stabilizer | 0.2 | 0.2 | 0.2 |
| sulfamic acid | acidic agent | 0.0 | 11.1 | 0.0 |
| nitric acid | acidic agent | 7.4 | 8.2 | 8.2 |

TABLE 11

| Comparative Formulation | Concentration, wt % | Processing Temperature, ° C. | Soil Removal, % |
|---|---|---|---|
| 3 | 1.00 | 40 | 39.0 |
| 4 | 1.00 | 40 | 39.0 |
| 5 | 1.00 | 40 | 38.2 |

The use of the Comparative Formulations 6, 7, 8, 9 and 10 of Table 12 were tested at a reduced processing temperature to identify if one or more of the functional ingredients have a positive influence on soil removal. The results of these tests are included in Table 13.

TABLE 12

| Compound | Function | Concentration, wt % Comparative Formulation 6 | 7 | 8 | 9 | 10 |
|---|---|---|---|---|---|---|
| water | product stabilization solvent | 63.6 | 65.0 | 63.4 | 63.0 | 57.1 |
| dipropylene glycol methyl ether | degreaser/ emulsifier solvent | 0.0 | 3.0 | 2.0 | 1.0 | 0.0 |
| xylene sulfonic acid Na salt | hydrotrope | 16.0 | 13.6 | 15.2 | 15.6 | 0.0 |
| cumene sulfonic acid Na salt | hydrotrope | 0.0 | 0.0 | 0.0 | 0.0 | 7.3 |
| ethylene diamine tetraacetic acid | sequestrant or chelating agent | 5.0 | 5.0 | 5.0 | 5.0 | 15.8 |
| polyacrylic acid (M = 4.5k) | sequestrant or chelating agent | 0.4 | 0.4 | 0.4 | 0.4 | 2.1 |
| alcohol alkoxylate (EO/PO) | surfactant | 5.0 | 3.0 | 4.0 | 5.0 | 1.5 |
| N,N-bis (3-aminopropyl) dodecylamine | biocide | 0.0 | 0.0 | 0.0 | 0.0 | 3.2 |
| sodium carbonate | alkalinity agent | 0.0 | 0.0 | 0.0 | 0.0 | 5.3 |
| sodium hydroxide | alkalinity agent | 10.0 | 10.0 | 10.0 | 10.0 | 7.6 |

TABLE 13

| Comparative Formulation | Concentration, wt % | Processing Temperature, ° C. | Soil Removal, % |
|---|---|---|---|
| 6 | 1.00 | 40 | 72.4 |
| 7 | 1.00 | 40 | 74.4 |
| 8 | 1.00 | 40 | 72.1 |
| 9 | 1.00 | 40 | 72.6 |
| 10 | 1.00 | 40 | 65.5 |

Of these comparative formulations, Comparative Formulation 7 performs the best while Comparative Formulation 10 performs the worst. Comparative Formulation 6 shows that a higher amount of surfactant may help to compensate for a lack of degreaser/emulsifier solvent. This is confirmed by the performance of Comparative Formulation 10, which also has no degreaser/emulsifier solvent and a lower amount of surfactant. Thus, the results of these tests show that some combination of amounts of degreaser/emulsifier solvent and surfactant help to improve the cleaning performance at reduced temperatures.

The inventors have recognized the importance of the concentration balance needed between a degreaser/emulsifier solvent and a surfactant that otherwise is not known by a person having ordinary skill in the art. Additionally, the formulations that perform better include the xylene sulfonic acid Na salt as a hydrotrope but at a reduced amount over the concentrations that may be otherwise contemplated by a person having ordinary skill in the art. Furthermore, while a combination of functional sequestrants or chelating agents is needed, especially including ethylene diamine tetraacetic acid (EDTA) and polyacrylic acid (M=4.5 k), but the concentration of EDTA should be reduced over that concentration that may be otherwise known to a person having ordinary skill in the art. Also, while alcohol (C13-15) alkoxylate (EO/PO) may be used as the surfactant, again the amount required tends to be reduced over the concentrations that an ordinary skilled artisan has come to know. Clearly, these combinations of improvements conceived of by the inventors have led to a formulation having enhanced effectiveness at a reduced processing temperature in the range of about 40° C. or less.

Example 5

Available commercial formulations have been tested to determine their effectiveness of use in a reduced temperature dairy equipment cleaning operation. The types of products associated with Commercial Formulations 1-7 are identified in Table 14.

TABLE 14

| Commercial Formulation | Product Description |
|---|---|
| 1 | Sequestrant Additive Formulation |
| 2 | Sequestrant/Surfactant/Hydrotrope Additive Formulation |
| 3 | Low Foaming High Alkalinity-based Full Formulation |
| 4 | Chlorinated Alkaline Full Formulation |
| 5 | Acid-based Full Formulation |
| 6 | Higher Sequestrant with Reduced Alkalinity-based Full Formulation |
| 7 | Lower Sequestrant with High Alkalinity-based Full Formulation |

The compounds and concentrations included in Commercial Formulations 1-7 are shown in Table 15.

TABLE 15

| | | Concentration, wt % Commercial Formulation | | | | | | |
|---|---|---|---|---|---|---|---|---|
| Compound | Function | 1 | 2 | 3 | 4 | 5 | 6 | 7 |
| Water | product stabilization solvent | 80.5 | 86.7 | 66.5 | 85.0 | 53.4 | 72.0 | 53.3 |
| alkyl aryl alkoxy phosphate ester K salt | hydrotrope | 0.0 | 0.2 | 0.0 | 0.0 | 0.0 | 0.3 | 0.0 |
| amino trimethylene phosphoric acid | sequestrant or chelating agent | 7.5 | 4.0 | 0.2 | 0.0 | 0.0 | 0.0 | 0.1 |
| gluconic acid Na salt | sequestrant or chelating agent | 12.0 | 6.0 | 0.8 | 0.0 | 0.0 | 0.0 | 3.8 |
| ethane hydroxy diphosphoric acid | sequestrant or chelating agent | 0.0 | 0.0 | 0.0 | 0.2 | 0.0 | 4.2 | 0.0 |
| phosphono-1,2,4-butanetricarboxylic acid | sequestrant or chelating agent | 0.0 | 0.0 | 0.4 | 0.0 | 0.0 | 0.0 | 0.0 |
| polyacrylic acid (M = 4.5k) | sequestrant or chelating agent | 0.0 | 0.0 | 0.0 | 0.3 | 0.0 | 0.0 | 0.0 |
| alcohol alkoxylate (EO/PO) | surfactant | 0.0 | 2.4 | 0.0 | 0.0 | 0.0 | 0.0 | 0.0 |
| alkyl (C8) ether (8EO) carboxylic acid | surfactant | 0.0 | 0.0 | 0.0 | 0.0 | 0.2 | 0.0 | 0.0 |
| alkyl (C8-10) polyglucoside | surfactant | 0.0 | 0.7 | 0.0 | 0.0 | 0.0 | 0.0 | 0.0 |
| Urea | stabilizer | 0.0 | 0.0 | 0.0 | 0.0 | 0.1 | 0.0 | 0.0 |
| nitric acid | acidic agent | 0.0 | 0.0 | 0.0 | 0.0 | 45.4 | 0.0 | 0.0 |
| phosphoric acid | acidic agent | 0.0 | 0.0 | 0.0 | 0.0 | 0.9 | 0.0 | 0.0 |
| sodium hydroxide | alkalinity agent | 0.0 | 0.0 | 32.2 | 10.5 | 0.0 | 23.5 | 42.8 |
| sodium hypochlorite | oxidizing agent | 0.0 | 0.0 | 0.0 | 4.0 | 0.0 | 0.0 | 0.0 |

Commercial Formulations 1 and 2 are intended to be used as an additive formulation, while Commercial Formulations 3 to 7 are full formulations that do not require the addition of any acidic or alkalinity agent. Table 16 includes the extent of soil reduction using Commercial Formulations 1 and 2 at various processing temperatures including a reduced processing temperature. Typical commercial use conditions of Commercial Formulation 1 are in combination with caustic and hypochlorite. Hypochlorite is not stable in the presence of Commercial Formulation 2, thus this Commercial Formulation is tested with caustic only.

Concentrations of additive, caustic and hypochlorite in these examples are those conventionally use used in the industry.

While the extent of soil reduction is somewhat large for Commercial Formulation 1, the use of the hypochlorite ion (C10") ion is required to achieve such a reduced soil removal. The use of hypochlorite ion is less preferred in certain operations and does require some special handling and may not be as preferred in certain types of cleaning operations. Additionally, hypochlorite ion can react with organic materials that would in the end show up as halogenated organic compounds in waste water, which is not preferred.

TABLE 16

| Commercial Formulation | Concentration, wt % Formulation | Alkalinity (NaOH) Agent | $ClO^-$ | Weight Ratio | Processing Temperature, ° C. | Soil Removal, % |
|---|---|---|---|---|---|---|
| 1 | 0.10 | 0.10 | 0.10 | 1:1 | 40 | 94.4 |
| 2 | 0.20 | 0.50 | 0.0 | 2:5 | 40 | 38.0 |
| | 0.20 | 0.50 | 0.0 | 2:5 | 50 | 41.0 |

Chlorine gas may also form in the cleaning process especially when the hypochlorite reacts with an acid (e.g., present in other cleaning products or acidic waste water streams), which could provide an unsafe environment in the cleaning operation.

Furthermore, in certain cleaning operations, it is preferred to operate in an alkaline pH and not an acidic pH. While chlorinated alkaline-based solutions can be performed at a reduced temperature, the chlorine generally has a negative impact such as, for example, on the environment and health implications.

Commercial Formulation 2 is a commercially viable formulation at higher temperatures, yet at a reduced temperature in combination with a more conventional concentration of alkalinity, as shown in Table 16, is not as effective even in the case when the temperature is increased. Commercial Formulation 4 shows that the use of chlorine allows for a reasonable soil removal to be achieved (see Table 17).

Table 17 includes the extent of soil reduction using Commercial Formulations 3, 4 and 5 at a varying processing temperature. In the case of Formulation 3, this demonstrates that increasing the temperature improves the soil removal at a constant formulation concentration and alkalinity level.

TABLE 17

| Commercial Formulation | Formulation Concentration, wt % | Processing Temperature, ° C. | Soil Removal, % |
|---|---|---|---|
| 3 | 1.00 | 40 | 42.5 |
| | 1.00 | 50 | 58.1 |
| | 1.00 | 70 | 92.5 |
| | 1.75 | 40 | 28.2 |
| | 1.75 | 70 | 41.6 |
| 4 | 1.00 | 40 | 66.8 |
| | 1.00 | 50 | 84.2 |
| | 1.00 | 70 | 88.2 |
| 5 | 1.00 | 40 | 34.7 |

TABLE 18

| Commercial Formulation Number | Concentration, wt % | Effective Amount of NaOH, wt % | Processing Temperature, ° C. | Soil Removal, % |
|---|---|---|---|---|
| 6 | 0.5 | 0.1 | 40 | 75.7 |
| 6 | 1.0 | 0.2 | 40 | 78.3 |
| 6 | 2.5 | 0.6 | 40 | 34.8 |
| 7 | 0.25 | 0.1 | 40 | 69.3 |
| 7 | 0.5 | 0.3 | 40 | 79.7 |
| 7 | 1.25 | 0.5 | 40 | 40.9 |

Table 18 shows the effect of varying alkalinity concentration on soil removal using varying concentrations of Commercial Formulation 6 and Commercial Formulation 7. This Table shows similar comparative results that are found in Table 7 using the formulations of the invention. As the data shows in this table, full formulations are only effective at reduced temperatures if the concentration of the alkalinity agent is lower than about 0.5 wt %. Conventionally, commercial formulations have been used at higher alkalinity level (e.g., Commercial Formulation 6 at an alkalinity level in the range of 0.5 to 1.0 wt % and Commercial Formulation 7 at an alkalinity level in the range of 0.25 to 0.5 wt %) and temperature than the formulations of the invention.

Example 6

Two additional formulations that have been found to provide adequate soil removal at a reduced processing temperature are shown in Table 19. The formulations of table 19 include the use of hydrotrope functional solvents, in particular, the amphoteric surfactant alkyl (C8) amino dipropionate mono Na salt and the nonionic surfactant alkyl (C8-10) polyglucoside.

TABLE 19

| Compound | Function | Concentration, wt % Formulation 6 | 7 |
|---|---|---|---|
| water | product stabilization solvent | 71.26 | 71.26 |
| ethylene diamine tetraacetic acid | sequestrant or chelating agent | 4.80 | 0.00 |
| methylglycine diacetic acid | sequestrant or chelating agent | 0.00 | 4.80 |
| polyacrylic acid (M = 4.5k) | sequestrant or chelating agent | 0.90 | 0.90 |
| alcohol (C13-15) alkoxylate (EO/PO) | surfactant | 0.20 | 0.20 |
| alkyl (C8) amino dipropionate mono Na salt | surfactant | 0.20 | 0.20 |
| alkyl (C8-10) polyglucoside | surfactant | 0.56 | 0.56 |
| NaOH | alkalinity agent | 22.08 | 22.08 |

Without intending to be limiting, an advantage of the advantage of Formulation 6 and Formulation 7 is a lower anticipated raw material cost, which, from an economic standpoint makes them preferred formulations. In contrast to Formulations 1, 2, 3, 4 and 5, Formulation 6 and Formulation 7 do not require a hydrotrope but rather a hydrotrope functional solvent as further disclosed herein.

Many modifications and other embodiments of the invention set forth herein will come to mind to one skilled in the art to which this invention pertains having the benefit of the teachings presented in the descriptions herein. It will be appreciated by those skilled in the art that changes could be made to the embodiments described herein without departing from the broad inventive concept thereof. Therefore, it is understood that this invention is not limited to the particular embodiments disclosed, but it is intended to cover modifications within the spirit and scope of the present invention as defined by the included claims.

That which is claimed:

1. A method of cleaning a dairy processing equipment, the method comprising:

preparing a cleaning solution from a formulation;

raising a temperature of the cleaning solution to less than about 50° C.; and contacting the cleaning solution with the dairy processing equipment to clean the dairy processing equipment, wherein the cleaning solution comprises:

an alkalinity agent chosen from sodium hydroxide sodium carbonate, potassium hydroxide, or any mixture thereof in an amount of from about 0.05% to about 0.35% by weight of the cleaning solution; and a sequestrant chosen from ethylenediamine tetraacetic acid (EDTA), methylglycine diacetic acid (MGDA), glutamate diacetate (GLDA), diethylene triamine pentaacetic acid (DTPA), hydroxyethylene diamine triacetic acid (HEDTA), nitrilotriacetic acid (NTA), poly(acrylic acid), or any mixture thereof, wherein the formulation is a chlorine-free formulation.

2. The method of claim 1, wherein a concentration of the alkalinity agent in the cleaning solution is from about 0.1 wt % to about 0.3 wt % by weight of the cleaning solution.

3. The method of claim 1, wherein the formulation further comprises a product stabilization solvent, a degreaser emulsifier solvent, a surfactant, a stabilizer, a biocide, a buffer, a hydrotrope, or any combination thereof.

4. The method of claim 1, further comprising:

holding the cleaning solution in the dairy processing equipment for a time needed to achieve a desired extent of soil removal, and discharging the cleaning solution from the dairy processing equipment.

5. The method of claim 1, wherein the temperature of the cleaning solution is raised to less than about 40° C.

6. The method of claim 3, wherein:

the product stabilization solvent comprises water;

the degreaser/emulsifier solvent comprises an alcohol, a glycol, or a mixture thereof;

the hydrotrope comprises a salt of cumene sulfonic acid, a salt of xylene sulphonic acid, a glycolic acid, a salt of a fatty acid, an amphoteric surfactant, a nonionic surfactant, or any combination thereof;

the surfactant comprises an alcohol alkoxylate that includes an ethylene oxide/propylene oxide (EO/PO), an alcohol alkoxylate that includes an ethylene oxide/butylene oxide (EO/BO), or both.

7. The method of claim 1, wherein the step of preparing a cleaning solution comprises:

providing the formulation comprising the sequestrant and the alkalinity agent;

combining the formulation with water to form the cleaning solution.

8. The method of claim 7, wherein the formulation comprises up to about 93.7 wt % of a product stabilization solvent, from about 1 wt % to about 20 wt % of a degreaser emulsifier solvent, from about 1 wt % to about 20 wt % of a hydrotrope, from about 0.1 wt % to about 30 wt % of the sequestrant, from about 0.2 wt % to about 20 wt % of a surfactant and from about 4 wt % to about 40 wt % of the alkalinity agent all by weight of the formulation.

9. The method of claim 7, wherein the formulation comprises from about 28.5 wt % to about 89.5 wt % of a product stabilization solvent, from about 2 wt % to about 10 wt % of a degreaser emulsifier solvent, from about 2.5 wt % to about 15 wt % of a hydrotrope, from about 0.5 wt % to about 27.5 wt % of the sequestrant, from about 0.5 wt % to about 5 wt % of a surfactant and from about 5 wt % to about 15 wt % of the alkalinity agent all by weight of the formulation.

10. The method of claim 7, wherein the formulation comprises from about 41.5 wt % to about 81 wt % of a product stabilization solvent, from about 4 wt % to about 6 wt % of a degreaser emulsifier solvent, from about 4.5 wt % to about 12 wt % of a hydrotrope, from about 2.25 wt % to about 27 wt % of the sequestrant, from about 0.75 wt % to about 2.5 wt % of a surfactant and from about 7.5 wt % to about 11 wt % of the alkalinity agent all by weight of the formulation.

11. The method of claim 1, wherein the step of preparing a cleaning solution comprises:

providing the formulation comprising the sequestrant;

combining the formulation and the alkalinity agent in water to form the cleaning solution.

12. The method of claim 11, wherein the cleaning solution comprises from about 0.10 wt % to about 0.50 wt % of the formulation based on total weight of the cleaning solution.

13. The method of claim 7, wherein the cleaning solution comprises from about 0.50 wt % to about 5.00 wt % of the formulation based on total weight of the cleaning solution.

14. The method of claim 1, wherein the temperature of the cleaning solution is raised to a temperature above the cloud point temperature of any surfactant in the cleaning solution, in order to prevent foaming of the cleaning solution.

15. The method of claim 6, wherein the amphoteric surfactant comprises an alkyl amino propionate, a salt of alkyl amino propionate, an alkyl amino dipropionate, a salt of alkyl amino dipropionate, or any combination thereof.

16. The method of claim 6, wherein the nonionic surfactant comprises an alkyl polyglucoside.

17. The method of claim 11, wherein the formulation comprises up to about 97.7 wt % of the product stabilization solvent, from about 1 wt % to about 20 wt % of the degreaser emulsifier solvent, from about 0.1 wt % to about 20 wt % of the hydrotrope, from about 0.1 wt % to about 20 wt % of the sequestrant, and from about 0.2 wt % to about 20 wt % of the surfactant all by weight of the formulation.

18. The method of claim 11, wherein the formulation comprises from about 45 wt % to about 92.5 wt % of the product stabilization solvent, from about 3 wt % to about 12 wt % of the degreaser emulsifier solvent, from about 0.2 wt % to about 15 wt % of the hydrotrope, from about 1 wt % to about 15 wt % of the sequestrant, and from about 0.5 wt % to about 18 wt % of the surfactant all by weight of the formulation.

19. The method of claim 11, wherein the formulation comprises from about 40 wt % to about 82.5 wt % of the product stabilization solvent, from about 8 wt % to about 10 wt % of the degreaser emulsifier solvent, from about 0.5 wt % to about 5 wt % of the hydrotrope, from about 3 wt % to about 12 wt % of the sequestrant, and from about 1 wt % to about 18 wt % of the surfactant all by weight of the formulation.

20. The method of claim 11, wherein the formulation comprises up to about 97.7 wt % of the product stabilization solvent, from about 1 wt % to about 20 wt % of the degreaser emulsifier solvent, from about 1 wt % to about 20 wt % of the hydrotrope, from about 0.1 wt % to about 20 wt % of the sequestrant, from about 0.2 wt % to about 20 wt % of the surfactant, all by weight of the formulation.

* * * * *